US007290598B2

(12) United States Patent
Hanin et al.

(10) Patent No.: US 7,290,598 B2
(45) Date of Patent: Nov. 6, 2007

(54) HEAT EXCHANGE DEVICE

(75) Inventors: Leonid Hanin, Pittsford, NY (US); Antonio Campo, Essex Junction, VT (US)

(73) Assignee: University of Rochester, Rochester, NY (US)

( * ) Notice: Subject to any disclaimer, the term of this patent is extended or adjusted under 35 U.S.C. 154(b) by 499 days.

(21) Appl. No.: 10/786,098

(22) Filed: Feb. 26, 2004

(65) Prior Publication Data

US 2005/0189099 A1 Sep. 1, 2005

(51) Int. Cl.
*F28F 7/00* (2006.01)

(52) U.S. Cl. ..... 165/185; 165/181; 29/890.045; 29/890.046

(58) Field of Classification Search ..... 165/185, 165/181, 183; 29/890.045, 890.046
See application file for complete search history.

(56) References Cited

U.S. PATENT DOCUMENTS 3,645,330 A 2/1972 Albright et al.
3,982,527 A * 9/1976 Cheng et al. ..... 126/690
4,007,729 A * 2/1977 Chao et al. ..... 126/684
4,041,524 A * 8/1977 Trunk et al. ..... 165/185
4,117,832 A * 10/1978 Lupkas ..... 165/185
4,369,838 A * 1/1983 Asanuma et al. ..... 165/185
4,669,685 A 6/1987 Dalby
4,838,347 A * 6/1989 Dentini et al. ..... 165/185
4,923,002 A 5/1990 Haussmann
4,935,864 A 6/1990 Schmidt et al.
5,077,601 A 12/1991 Hatada et al.
5,229,643 A 7/1993 Ohta et al.
5,628,362 A 5/1997 Rew et al.
5,660,230 A 8/1997 Obosu et al.
5,729,988 A 3/1998 Tchernev
5,896,269 A * 4/1999 Autry ..... 165/185
5,955,781 A 9/1999 Joshi et al.

(Continued)

OTHER PUBLICATIONS

S.K. Hati, S.S. Rao, Transactions ASME, Journal of Vibration, Acoustics, Stress, and Reliability in Design, Determination of Optimum Profile of One-Dimensional Cooling Fins, Jul. 1983, vol. 105, pp. 317-320.

(Continued)

*Primary Examiner*—Ljiljana Ciric
(74) *Attorney, Agent, or Firm*—Blank Rome LLP

(57) ABSTRACT

A heat transfer device having a heat source for collecting waste heat from a heat-generating system, the heat transfer device having fins in which the shape of the sides of the fins is preferably circular according to the general expression $$\left(x-\frac{1}{\gamma}\right)^2+\left(y-\frac{\rho}{\gamma}\right)^2=\frac{1}{\gamma^2},$$

where $$\gamma=\frac{h}{k},$$

h is the heat transfer coefficient between the fin and the surrounding fluid, k is the thermal conductivity of the fin material, $$\rho=\frac{q_o}{k\theta_o},\ q_o$$

is the heat flow through the fin semi-base per unit depth and $\theta_0$ is the difference between the temperatures of the heated surface and the surrounding fluid.

15 Claims, 2 Drawing Sheets

U.S. PATENT DOCUMENTS

| | | | |
|---|---|---|---|
| 6,015,008 | A | 1/2000 | Kogure et al. |
| 6,161,610 | A | 12/2000 | Azar |
| 6,538,892 | B2 | 3/2003 | Smalc |
| 2002/0074114 | A1 | 6/2002 | Fijas |

OTHER PUBLICATIONS

C.J. Maday, Transactions of the ASME, Journal of Engineering for Industry, The Minimum Weight One-Dimensional Straight Cooling Fin, Feb. 1974, pp. 161-165.

L. Hanin, A. Campo, International Journal of Heat and Mass Transfer, vol. 46, 2003, p. 5145-5152.

R.J. Duffin, Journal of Mathematics and Mechanics, A Variational Problem Relating to Cooling Fins, vol. 8, No. 1, 1959, pp. 47-56.

S. Graff et al., Heat Transfer Engineering, Mathematical Analysis of the Length-of-Arc Assumption, vol. 17, No. 2, 1996, pp. 67-71.

D.R. Harper, III et al., Report No. 158, Mathematical Equations for Heat Conduction in the Fins of Air-Cooled Engines, pp. 679-708.

* cited by examiner

HEAT EXCHANGE DEVICE

BACKGROUND OF THE INVENTION

1. Field of the Invention

The present invention relates to heat exchange devices and, more particularly, to a heat dissipating fin associated with a heat exchange device.

2. Description of the Related Art

Whenever energy is used to perform work, part of the energy may be converted to thermal energy in accordance with the first law of thermodynamics. For example, when energy in the form of a voltage potential is used to cause electrons to move in conductive materials, such as, for example, in a transistor, part of the energy is converted to thermal energy. On a macroscopic scale, when an energy source is used to move two materials that are in contact with each other, such as a rotating shaft on a bushing, the irregularities on the surface of the two materials interact, causing friction and the conversion of some of the source energy to thermal energy.

In those examples, the change in the internal energy of the system, that is, the conversion of energy to thermal energy, reflects the fact that systems are not one-hundred percent efficient. To maximize the efficiency of such a system, the thermal energy by-product must be removed from or transferred out of the system. Therefore, the characteristics of heat transfer, or heat exchange, become a crucial design element for many systems.

The term heat refers to the exchange of the thermal energy being transferred from a hot body to a cold body. When the hot body and the cold body come in contact with each other, the heat will flow from the hot body to the cold body until they both reach the same temperature (i.e., thermal equilibrium). Heat is capable of being transferred through solid and fluid media by conduction, through fluid media by convection, and through vacuum by radiation. The challenge in designing a heat exchange device that takes advantage of those heat transfer mechanisms is to design one that balances efficiency with economics. Often, the most efficient heat exchange devices are expensive to manufacture and operate. Less expensive devices may not achieve the desired heat transfer efficiency.

Fins are surface extensions frequently used in heat exchange devices for the purpose of increasing heat transfer rates, and hence overall heat transfer efficiency, between a hot body (e.g., a solid surface at a high temperature) and a cold body (e.g., a fluid surrounding the solid surface at a lower temperature). With fins, heat will flow from the high temperature solid surface (source) to the lower temperature fluid surrounding the solid surface (sink) so that eventually a constant temperature difference between the surface and the fluid (i.e., dynamic thermal equilibrium) will be reached. Heat transfer efficiency can be increased further through forced convection by using fans or pumps to move the fluid relative to the solid surface.

In many applications, fins require no maintenance. Therefore, operating costs associated with those fins are essentially negligible. Thus, in addition to increasing heat transfer rates, fins are economically attractive for use in certain systems.

Theoretical and experimental studies have suggested that the thermal efficiency of fins depends on their shape. Fins with variable thickness were first considered in *Mathematical Equations for Heat Conduction in the Fins of Air Cooled Engines* by D. R. Harper and W. B. Brown (NACA Report No. 158 (1922)) and in *Die Wärmeübertragung durch Rippen*, by E. Schmidt (Z. Ver. Deut. Ingenieure 70, at 885-889, 947-951 (1926)). The problem addressed by those references consisted of minimizing the volume of a straight symmetric fin that dissipates a given amount of heat at a given temperature difference to the ambient fluid. In the former reference, the problem of finding an optimal fin design was not addressed. In the later reference, the problem was solved using the "length of arc" assumption.

From a physical standpoint, the "length of arc" assumption is equivalent to the assumption that heat is dissipated from the fin to the surrounding fluid in the direction orthogonal to the plane of symmetry of the fin (i.e., in the y-axis direction as shown in FIGS. 1-6). In reality, however, the direction of heat flux from the fin to the fluid is orthogonal to the fin surface. Thus, in the case of the triangular-shaped fin illustrated in FIG. 2, for example, the heat transfer is dissipated out from the sides of the fin at an angle 90°-$\alpha$, relative to the x-axis shown.

In Schmidt's study, with the "length of arc" assumption employed, it was found that the best dimensions for a straight fin are those that produce a linear temperature profile along the length of the fin (from its base to its tip). In that situation, the heat flux along the fin is uniform (the validity of Schmidt's analysis was confirmed mathematically in *A Variational Problem Relating to Cooling Fins*, by R. J. Duffin (J. Math. Mech. 8:47-56 (1959))). Proceeding from the linear temperature distribution along the fin length, Schmidt found that the optimum profile of a straight fin is convex parabolic, as illustrated in FIG. 3. The shape of the parabola in FIG. 3 is determined by two pre-specified quantities of thermal nature: the ratio, $\gamma$, of the heat transfer coefficient, h, between the fin and the fluid and the thermal conductivity, k, of the fin material, i.e., $\gamma=h/k$, and the dimensionless quantity $\rho=q_o/(k\,\theta_0)$, where $q_o$ is the heat flow through the fin semi-base per unit depth and $\theta_0$ is the difference between the temperatures of the heated surface and the surrounding fluid.

A key assumption shared by later practitioners, as discussed to some extent in *Heat Transfer*, by M. Jakob (10th ed., vol. 1, Wiley, New York, pp. 217-221 (1967)), is the omission of the curvature of the fin profile from the analysis of fins (i.e., omission of the "length of arc" assumption). In *The Minimum Weight One-Dimensional Straight Cooling Fin*, by C. J. Maday (ASME J. Eng. Ind. 96:161-165 (1974)), the impact of the "length of arc" assumption is analyzed with regard to the optimum profile shape of straight fins. It points out that the differential area element of the semi-surface per unit depth applicable to the straight fin should be expressed by the relation $dS=[(1+(y')^2)^{1/2}]dx$, where $y=y(x)$ stands for the fin profile function (see FIG. 3). In particular, the approximation $dS\approx dx$ is equivalent to the "length of arc" assumption.

The problem of finding an optimum fin design has been centered on a search for the optimum fin length L, fin semi-height at the fin base, $y_o$, and the fin profile $y=y(x)$, $0\leqq x\leqq L$, $y(0)=y_o$ (see FIG. 3), given the thermal parameters $q_o$, $\theta_0$, h and k. In contrast to this, the goal established in *The Minimum Weight One-Dimensional Straight Cooling Fin* was to find a minimum volume fin with a fixed $y_o$. The two-point boundary value problem was solved numerically using the Pontryagin's Maximum Principle. The optimum profile reported is reasonably close to Schmidt's convex parabolic profile for a large initial portion of the fin length, but closer to the end contains some wavy irregularities. In addition, the volume of the fin was only slightly smaller than the volume of Schmidt's fin with the same height. An important numerical finding was that, with the "length of arc" assumption omitted, the temperature distribution for the optimum fin was still linear.

Thus, before the present invention, the exact profile of a straight, solid heat exchange fin that minimizes the fin volume and produces dissipation of a given heat flow per unit depth to the surrounding fluid at a given temperature excess at the fin base had not been known. Previous theoretical heat exchange devices relied on imperfect fin profiles to transfer heat, thus limiting the thermal efficiency of the devices. Moreover, those previous fin shapes were selected for economical reasons as much as for efficiency. For example, a rectangular-shaped fin shown in FIG. 1, with dimensions L (length)×W (width)×H (height), is relatively easy to manufacture, but is inefficient from a thermal performance perspective. Thermal characteristics of a rectangular-shaped fin are presented in *Mathematical Equations for Heat Conduction in the Fins of Air Cooled Engines*, by D. R. Harper and W. B. Brown (NACA Report No. 158 (1922)).

It is well known that to economize on the weight of the fin, it should taper approximately to a point in the direction of heat flow. Thus, triangular-shaped fins, as shown in FIG. 2, would be preferable over rectangular-shaped fins. In one aspect, triangular-shaped fins cost less than rectangular fins because they use less material, but overall they can be more expensive to manufacture because of the angled surfaces. Nevertheless, triangular-shaped fins are more efficient than rectangular-shaped fins and are often used in heat exchange devices. Thermal characteristics of a triangular-shaped fin are presented in *Mathematical Analysis of the Length-of-Arc Assumption*, by S. Graff and A. D. Snider (Heat Transfer Eng. 8 (2):67-71 (1996)).

The convex-parabolic-shaped fin shown in FIG. 3 is even more efficient than the rectangular- and triangular-shaped fins, but is more expensive to manufacture because of the curved sides of the fin and because the overall size of the fin requires more material to make it. Thermal characteristics of the convex-parabolic-shaped fin design is discussed, to some extent, in *Heat Transfer and in Mathematical Analysis of the Length-of-Arc Assumption* cited above.

Another fin design is one that is semi-rectangular shaped, as shown in FIG. 4. Thermal characteristics of a semi-rectangular shaped fin are described in *Determination of the Optimum Profile of One-Dimensional Cooling Fins*, by S. K. Hati and S. S. Rao (ASME J. Vib. Acoust. Stress Reliab. Des. 105:317-320 (1983)). That publication discloses using a numerical technique to find that the optimum fin profile has a depth that gradually increases toward the middle of the fin length and then decreases continuously. About two-thirds of the total heat is transferred to the surroundings from the first half of the length of the fin.

Straight, curved, and convex fins are disclosed in U.S. Pat. No. 4,669,685 to Dalby for use in dissipating heat generated by systems enclosed in a satellite. Trapezoidal and rectangular-shaped fins are disclosed in U.S. Patent Appl. Publication No. 2002/0074114-A1 to Fijas for use in dissipating heat in a fin-tubed heat exchanger. U.S. Pat. No. 5,729,988 to Tchernev illustrates how a straight, triangular-shaped fin is used to dissipate heat in a heat pump system. U.S. Pat. No. 6,161,610 to Azar discloses arc-shaped (half-round) fins (non-solid).

Until the present invention, heat exchange fins were not optimal in terms of heat transfer efficiency. In contrast to previous fins, the present invention minimizes the fin volume and at the same time procures the dissipation of a given heat flow per unit depth at a given temperature difference to the surrounding fluid and takes full account of the curvature of the fin surface.

SUMMARY AND OBJECTS OF THE INVENTION

The heat exchange device of the present invention has a heat transfer fin that is approximately straight, solid, and has sides approximately in the shape of an arc of a circle. In the preferred embodiment of the invention, the shape of the sides of the fin is given by the equation:

$$\left(x-\frac{1}{\gamma}\right)^2+\left(y-\frac{\rho}{\gamma}\right)^2=\frac{1}{\gamma^2},$$

which, graphically, represents a circle. In that equation, $$\gamma=\frac{h}{k},$$

where h is the heat transfer coefficient between the fin and the surrounding fluid, k is the thermal conductivity of the fin material, and $$\rho=\frac{q_o}{k\theta_o},$$

where $q_o$ is the heat flow through the fin semi-base per unit depth and $\theta_0$ is the difference between the temperatures of the heated surface and the surrounding fluid.

The fin of the present invention is shorter and has a larger semi-height at the base than the corresponding convex-parabolic-shaped fin. The volume of the present fin is from six to eight times smaller than the volume of the corresponding convex-parabolic-shaped fin.

The analytical method used to obtain the shape of the present invention is presented in *A New Minimum Volume Straight Cooling Fin Taking Into Account the "Length of Arc,"* by L. G. Hanin and A. Campo (International J. of Heat and Mass Transfer, 46: 5145-5152 (2003)), which is incorporated herein by reference in its entirety and discussed substantially below.

Accordingly, it is a principal object of the present invention to provide a heat exchange device having fins with sides approximately in the shape of an arc of a circle to maximize the heat transfer efficiency of a system.

It is another object of the present invention to provide a heat exchange device having circular-arc-shaped fins to maximize the heat transfer efficiency of a system.

It is still another object of the present invention to provide circular-arc-shaped fins for use in various heat exchange devices.

It is another object of the present invention to provide a method for making a circular-arc-shaped fin for use in various heat exchange devices.

These and other objects and features of the present invention are accomplished as embodied and fully described herein by a heat exchange device comprising a heat source for receiving thermal energy and a heat dissipating fin for dissipating the thermal energy of the source, wherein the sides of the fin have approximately the shape of a circular arc. The arc is a portion of a circle defined by the expression:

$$\left(x-\frac{1}{\gamma}\right)^2+\left(y-\frac{\rho}{\gamma}\right)^2=\frac{1}{\gamma^2}$$

where and $\gamma$ and $\rho$ are defined previously. The cross-sectional dimensions of that fin are defined by its base according to the semi-height dimension, $y_o$, a first arcuate side and a second arcuate side according to radius R, arc length dimension S, and length L, determined by the expressions $$y_o=\frac{\rho}{\gamma},\ R=1/\gamma,\ S=\frac{\sin^{-1}\rho}{\gamma},\ \text{and}\ L=\frac{1}{\gamma}\left(1-\sqrt{1-\rho^2}\right).$$

The fin may be substantially straight over its width dimension and is typically solid (often homogeneous). A portion of the fin may not be attached to the heat source. In operation, the thermal energy is produced within a system and dissipated out of the system by transferring it to a fluid surrounding the fin, which may be moved relative to the fin surface by way of a pump or fan.

Other objects, features and advantages of the present invention will become evident to one skilled in the art from the following detailed description of the invention in conjunction with the referenced drawings.

DETAILED DESCRIPTION OF THE INVENTION

Figure 5:
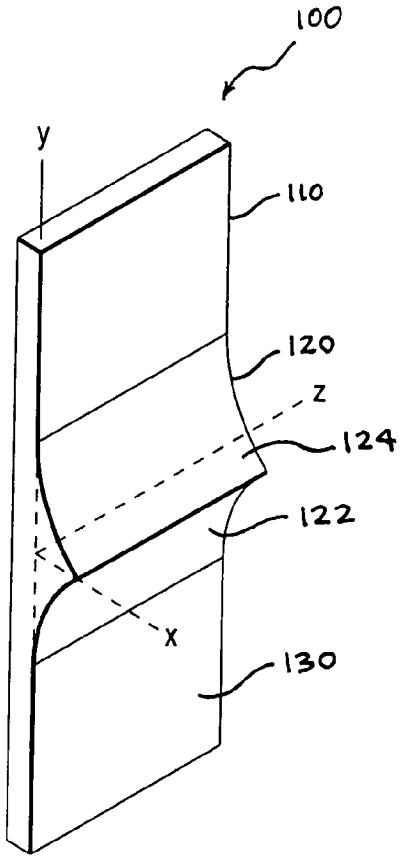
FIG. 5 is a perspective view drawing of a heat exchange device with a circular-arc-shaped fin according to the present invention.
Figure 4:
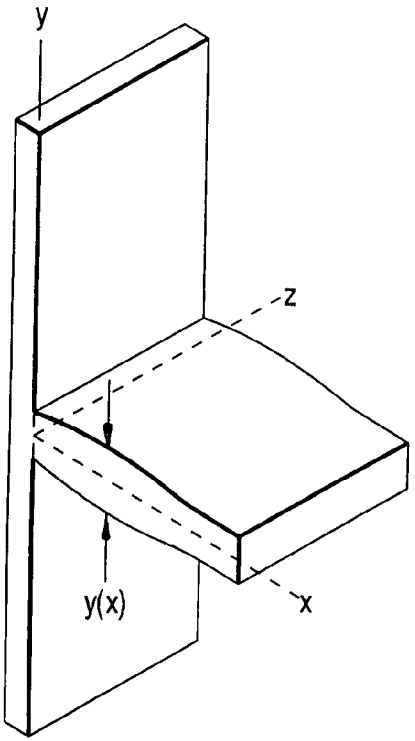
FIG. 4 (PRIOR ART)
FIG. 4 is a perspective view drawing of a prior art tapered rectangular-shaped heat exchange fin.

In the present invention, one preferred embodiment is described for illustrative purposes, it being understood that other embodiments are also within the scope of the invention. Turning first to FIG. 5, there is shown a perspective view drawing of a heat exchange device 100 having a heat source 110 and an approximately circular-arc-shaped fin 120 attached thereto.

The heat source 110 represents a component of a system that, by conduction, convection or radiation mechanisms, receives waste thermal energy generated by the system. For example, the heat source 110 may be a printed circuit board that has embedded heat-generating transistor circuits. The heat source 110 may also be a metal plate that is heated by exposure to a radiation source. It could also be part of the wall of a heat exchange tube that encloses a high temperature fluid passing through the tube. In FIG. 5, the heat source 110 is shown with orthogonal dimensions defined by an x-y-z coordinate system for ease of reference. However, it could include surfaces that are arcuate.

The system in which the heat source 110 operates can represent any open or closed system that satisfies the first law of thermodynamics. That is, energy can be exchanged between the system of interest and its surroundings, but the total energy of the system plus the surroundings is constant. In the above examples, which are not meant to be limiting in any way, an electronic device having a heat-generating printed circuit board could be considered a system. Likewise, a shell-and-tube heat exchanger having a plurality of finned-tubes could be considered a system.

The preferred embodiment of the fin 120, as shown in FIG. 5, is a longitudinally-extending (i.e., in the z-direction) straight fin. The preferred embodiment of the fin 120 is also solid. It will be appreciated, however, that the fin 120 may have bends along its longitudinal axis and it could also contain portions that are not solid (i.e., it may include voids, cutouts, etc.).

Figure 6:
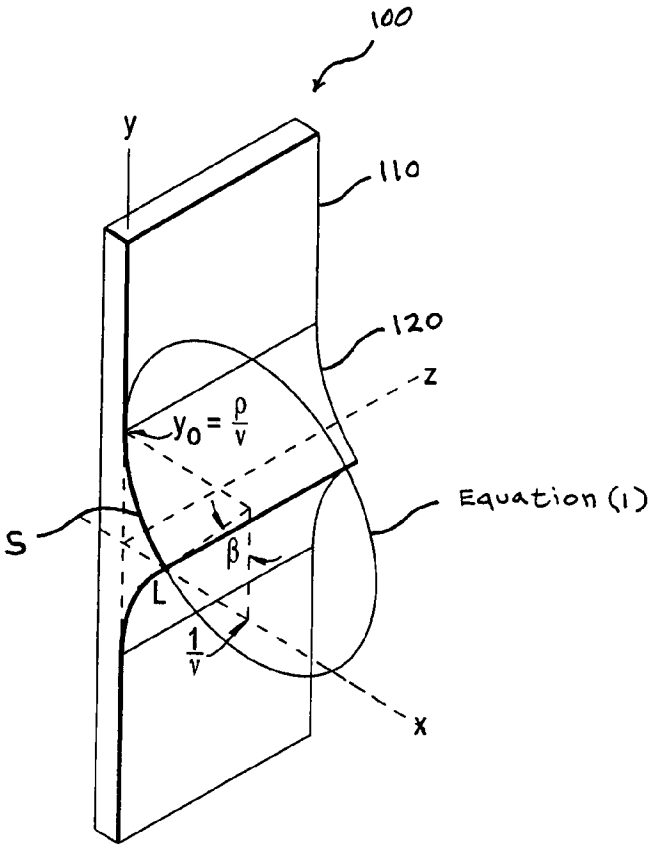
FIG. 6 is another perspective view drawing of a heat exchange device with a circular-arc-shaped fin according to the present invention.

In FIG. 5, the fin 120 is shown physically attached to the heat source 110. However, all or a portion of the fin 120 may not be in mechanical contact with the heat source 110. The base portion of the fin 120, as shown in FIGS. 5 and 6, is of rectangular shape with the dimensions expressed by $2\cdot(\rho/\gamma)$ times the length of the fin 120 in the longitudinal direction. In that expression, $$\rho=\frac{q_o}{k\theta_o},$$

where $q_o$ is the heat flow through the fin semi-base per unit depth and $\theta_0$ is the difference between the temperatures of the heated surface and the surrounding fluid;

$$\gamma=\frac{h}{k},$$

where h is the heat transfer coefficient between the fin and the fluid and k is the thermal conductivity of the fin material.

In operation, heat is conducted from the heat source 110 to the base portion of the fin 120. That heat energy is then conducted from the base portion of the fin 120 along the x-axis direction and then transferred to the surrounding fluid that is in contact with the top surfaces 122, 124 of the fin 120 by convection and radiation. Where forced convection is used to increase the heat transfer efficiency, a fan, pump or other suitable device (not shown) may be used to provide the force necessary to move the fluid in relation to the fin 120.

In the case where the fin 120 may have portions that are physically separate from the heat source 110, the heat source 110 could radiate heat energy in a direction that is orthogonal to its top surface 130, which would then impact the base portion of the fin 120 and cause the internal temperature of fin 120 to increase (i.e., raise the internal energy state of the fin 120). That heat energy is then conducted from the base portion of the fin 120 along the x-axis direction and then transferred to the surrounding fluid that is in contact with the top surfaces 122, 124 of the fin 120 by convection and radiation.

FIG. 6 is another perspective view drawing of the heat exchange device having a circular-arc-shaped fin according to the preferred embodiment of the present invention. In FIG. 6, the shape of the top surfaces 122, 124 of the fin 120 are given by the following equation $$\left(x-\frac{1}{\gamma}\right)^2+\left(y-\frac{\rho}{\gamma}\right)^2=\frac{1}{\gamma^2}. \tag{1}$$

That equation is obtained as follows. One of ordinary skill in the art will understand that the basic heat transfer equation that governs the heat transfer along a fin is:

$$q=-ky\frac{d\theta}{dx}, \tag{2}$$

where q is the heat flow through the fin cross-section per unit depth, y=y(x) is the fin profile function, θ is the temperature difference between the fin and a surrounding fluid. Further, the heat transfer from the fin to the ambient fluid is described by the equation:

$$\frac{dq}{dx}=-h\theta\sqrt{1+(y')^2}. \tag{3}$$

The following boundary conditions, I-III, apply to equations (2) and (3):

$$\theta(0)=\theta_0, \tag{I}$$

$$q(0)=q_0, \tag{II}$$

and $$y(L)\left(\frac{d\theta}{dx}\right)(L)=0. \tag{III}$$

Differentiating equation (2) in x and using equation (3), a second order differential equation for the temperature difference, θ, is obtained that involves the fin profile function y(x). According to a general physical principle due to Schmidt (1926) (which is independent of the "length of arc" assumption and was proved mathematically with the "length of arc" assumption by Duffin (1959) and confirmed numerically without this assumption by Maday (1974)), the temperature profile for the optimal fin is linear: $\theta(x)=\theta_0-mx$, where m>0. In this case, the above differential equation for θ becomes first order, and boundary condition (III) becomes simply y(L)=0 (that is, the thickness of the optimal fin at its end must be zero). The first order differential equation has the following solution for y:

$$y(x)=\left(\frac{1}{\gamma}\right)\left[\sqrt{1-\gamma^2(\mu-L)^2}-\sqrt{1-\gamma^2(\mu-x)^2}\right]. \tag{4}$$

Then, $y_o$ becomes:

$$y_o=\left(\frac{1}{\gamma}\right)\left[\sqrt{1-\gamma^2(\mu-L)^2}-\sqrt{1-\gamma^2\mu^2}\right]. \tag{5}$$

Geometrically, solution (4) describes an arc of a circle given by the following equations:

$$(x-\mu)^2+(y-v)^2=\frac{1}{\gamma^2}, \tag{6}$$

where $$v=\left(\frac{1}{\gamma}\right)\sqrt{1-\gamma^2(\mu-L)^2}. \tag{7}$$

In equation (7), γ is defined as above, $\mu=\theta_0/m$, where $\theta_0$ is defined as above and m is the slope of the linear temperature profile, and L is the fin length in the x-direction.

The family of circles of equations (6) and (7) depends on only two parameters: μ>0 and L>0, subject to the conditions $0<L\leqq\mu\leqq 1/\gamma$. Using equation (2) for x=0 and equation (5) provides the relationship between those parameters.

For a given fin depth W, the volume of the fin 120 is proportional to its cross-sectional semi-area:

$$A=\int_0^L y(x)dx. \tag{8}$$

This area can be computed by integrating y(x) from equation (4). Then minimizing the area with respect to the remaining parameter leads to the following optimal fin profile:

$$y(x)=\frac{1}{\gamma}\left[\rho-\sqrt{1-(1-\gamma x)^2}\right],\quad 0\le x\le\frac{1}{\gamma}\left(1-\sqrt{1-\rho^2}\right). \tag{9}$$

Graphically, this function represents an arc of a circle, as shown in FIG. 6, with the equation:

$$\left(x-\frac{1}{\gamma}\right)^2+\left(y-\frac{\rho}{\gamma}\right)^2=\frac{1}{\gamma^2}. \tag{10}$$

The radius of the circle (10) is given by $$R=\frac{1}{\gamma}. \tag{11}$$

Since the central angle of the arc is $$\beta=\frac{\pi}{2}-\sin^{-1}\rho, \tag{12}$$

the length of the arc S (i.e., the circular arc forming the sides of the fin as shown on FIG. 6), is given by the equation:

$$S=\frac{\sin^{-1}\rho}{\gamma}. \tag{13}$$

The height of the semi-base is:

$$y_o = \frac{\rho}{\gamma}, \tag{14}$$

and the length of the fin in the x-direction equals:

$$L = \frac{1}{\gamma}\left(1 - \sqrt{1-\rho^2}\right). \tag{15}$$

Figure 1:
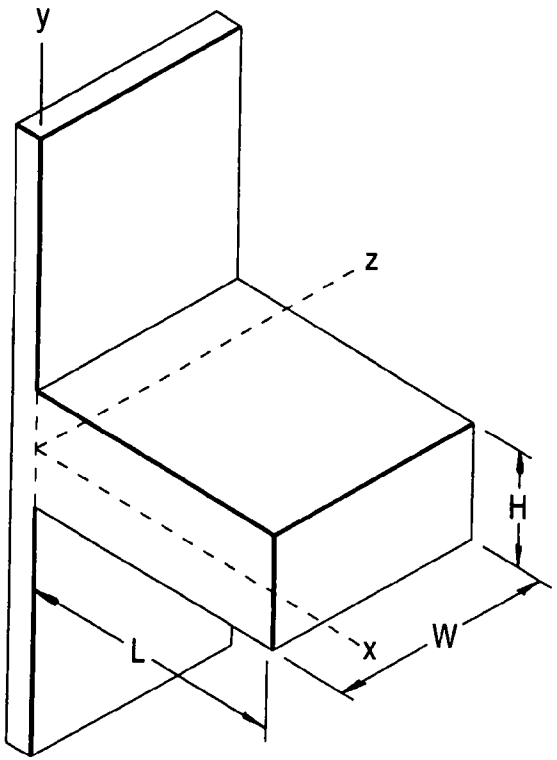
FIG. 1 (PRIOR ART)
FIG. 1 is a perspective view drawing of a prior art rectangular-shaped heat exchange fin.
Figure 2:
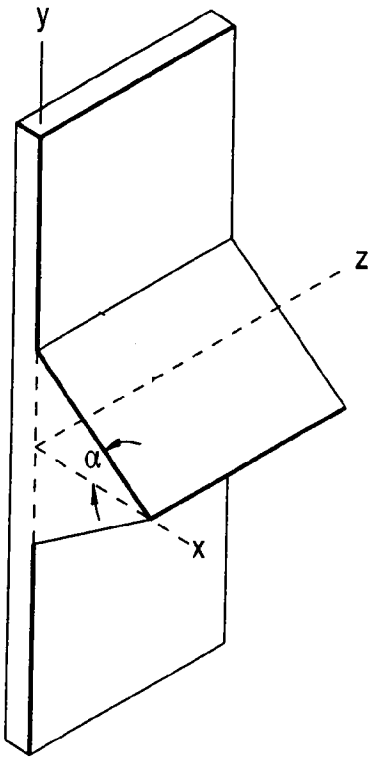
FIG. 2 (PRIOR ART)
FIG. 2 is a perspective view drawing of a prior art triangular-shaped heat exchange fin.
Figure 3:
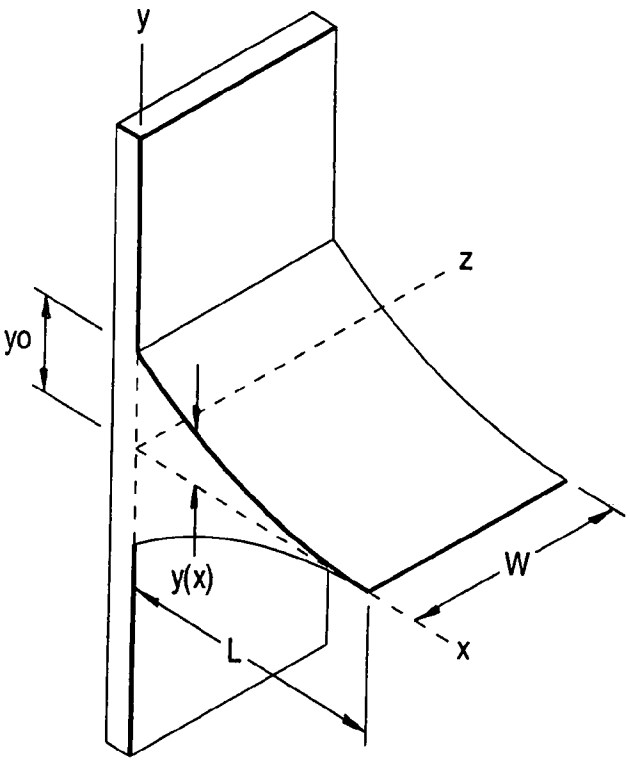
FIG. 3 (PRIOR ART)
FIG. 3 is a perspective view drawing of a prior art convex-parabolic-shaped heat exchange fin.

The advantage in thermal performance of the circular-arc-shaped fin according to the preferred embodiment of the invention, as compared to the convex-parabolic-shaped fin, is due to the fact that the distance from the heated wall to the fin surface is much shorter for the fin shown in FIG. 5 than for the fin shown in FIG. 3.

Another factor that has a bearing on the thermal performance of a fin is its surface area. Although the convex-parabolic-shaped fin is substantially longer and has more than six times larger profile area than the circular-arc-shaped fin, it has been determined that its surface area is only 1.88 to 2.30 times larger than that of the circular-arc-shaped fin.

It has also been determined that the circular-arc-shaped fin requires from 6.21 to 8 times less material than the comparable convex-parabolic-shaped fin for the same heat flow per unit depth, $q_o$, and temperature excess at the fin base, $\theta_0$.

Clearly, while the preferred embodiment of the invention is more thermally efficient and, because of its relatively smaller size, is economically cheaper to make compared to the convex-parabolic-shaped fin, the present invention is not limited to fins that are perfectly circular-arc-shaped. It will be appreciated that the sides 122, 124 of the fin 120 may be other than perfectly circular and still be more thermally efficient and less expensive to make than the convex-parabolic-shaped fin. For example, a fin profile that is slightly convex and not perfectly circular can be used to achieve satisfactory performance in the heat transfer device 100.

The fin 120 may be made from any suitable material that includes, but is not limited to, aluminum, copper, iron, nickel, magnesium, and titanium alloys; intermetallic alloys; refractory metals; ceramics; certain tool alloys; certain polymer, polymer composites, and elastomers; epoxies; semiconductor materials; and glasses and metallic glasses. Aluminum, with a thermal conductivity of about 2.3 watts per centimeter-Kelvin (W/cm-K), and copper, with a thermal conductivity of about 3.9 W/cm-K (both measured at 20° C.), are preferred because of their relatively high conductivities and low material costs (compared to, for example, gold (k=2.9 W/cm-K) and silver (k=4.2 W/cm-K)).

The heat source 110 and the fin 120 may be made from an integral piece of material, as shown in FIG. 5, or they may be made from different materials. Where direct contact between the heat source 110 and the fin 120 is desired, it is advantageous that the point of contact be optimal to minimize the resistance to heat transfer and, therefore, maximize heat transfer. Various machining techniques may be used to manufacture the heat source 110 and fin 120 to achieve that optimal contact. The fin 120 may be attached to the heat source 110 by mechanical knurling, backfilling, controlled deformation, and welding techniques, to name a few.

One of ordinary skill in the art will appreciate that a plurality of fins, each having a shape similar to the shape of the fin 120, can be optimally arranged on the heat source 110 to produce a heat transfer device 100 that efficiently and economically transfers waste thermal energy out of the system of interest.

Although this invention has been described in connection with specific embodiments, objects and purposes for the invention, it will be appreciated by one of skill in the art that various modifications of the invention, other than those discussed above, may be resorted to without departing from the nature and scope of the invention.

What is claimed is:

1. A heat dissipating fin comprising:

a longitudinally-extending base portion, a first longitudinally-extending approximately circular side, and a second longitudinally-extending approximately circular side, wherein the length of the fin, L, is approximately, $$L = \frac{1}{\gamma}\left(1 - \sqrt{1-\rho^2}\right), \quad \text{where } \gamma = \frac{h}{k} \text{ and } \rho = \frac{q_o}{k\theta_o},$$

and where h is a heat transfer coefficient between the fin and a surrounding fluid, k is a thermal conductivity of the material used to make the fin, $q_o$ is a heat flow through the fin semi-base per unit depth, and $\theta_0$ is a difference between a temperatures of a surface of the fin and the surrounding fluid.

2. The fin according to claim 1, wherein the sides are defined by the expression $$\left(x - \frac{1}{\gamma}\right)^2 + \left(y - \frac{\rho}{\gamma}\right)^2 = \frac{1}{\gamma^2}, \text{ where } \gamma = \frac{h}{k} \text{ and } \rho = \frac{q_o}{k\theta_o}.$$

3. The fin according to claim 1, wherein the cross-sectional dimensions of the fin are defined by its base according to the semi-height dimension, $y_o$, a first arcuate side and a second arcuate side according to radius R, an arc length dimension S, and the length L, determined by the expressions $$y_o = \frac{\rho}{\gamma},\ R = \frac{1}{\gamma},\ S = \frac{\sin^{-1}\rho}{\gamma}, \text{ and } L = \frac{1}{\gamma}\left(1 - \sqrt{1-\rho^2}\right).$$

4. The fin according to claim 1, wherein the fin is substantially straight over its width dimension.

5. The fin according to claim 1, wherein the fin is solid.

6. The fin according to claim 1, wherein the fin is homogeneous.

7. The fin according to claim 1, wherein the fin is made from a material selected from the group consisting of aluminum, copper, iron, nickel, magnesium, titanium, intermetallic alloys, refractory metals, ceramics, tool alloys, polymers, polymer composites, elastomers, epoxies, semiconductors, glasses and metallic glasses.

8. The fin according to claim 1, wherein thermal energy received in the base portion is dissipated from the outer surfaces of the first and second approximately circular sides to a fluid surrounding the approximately circular sides.

9. The fin according to claim 1, wherein the longitudinally-extending base portion is rectangular shape with the dimensions expressed by 2·(p/γ) times a length z of the fin in the longitudinal direction, where $$\gamma = \frac{h}{k} \text{ and } \rho = \frac{q_o}{k\theta_o},$$

and where h is a heat transfer coefficient between the fin and a surrounding fluid, k is a thermal conductivity of the material used to make the fin, $q_o$ is a heat flow through the fin semi-base per unit depth, $\theta_0$ is a difference between a temperatures of a surface of the fin and the surrounding fluid, and z is any value greater than zero.

10. A heat dissipating fin for conducting thermal energy from a source to a fluid surrounding the fin, the fin comprising base and first and second side portions, wherein the width of the base portion, w, is approximately w=2·(ρ/γ), the length of the arc of the side portions, S, is approximately $$S = \frac{\sin^{-1}\rho}{\gamma},$$

the length of the fin, L, is approximately $$L = \frac{1}{\gamma}\left(1 - \sqrt{1-\rho^2}\right),$$

and wherein the first and second sides are approximately the shape of $$\left(x - \frac{1}{\gamma}\right)^2 + \left(y - \frac{\rho}{\gamma}\right)^2 = \frac{1}{\gamma^2}, \text{ where } \gamma = \frac{h}{k}, \rho = \frac{q_o}{k\theta_o},$$

h is a heat transfer coefficient between the fin and the fluid, k is a thermal conductivity of the material used to make the fin, $q_o$ is a heat flow through the fin semi-base per unit depth, and $\theta_0$ is a difference between a temperatures of a surface of the fin and the fluid.

11. The fin according to claim 10, wherein the base and side portions form an enclosed substantially rectangle shape.

12. The fin according to claim 10, wherein the fin is solid.

13. The fin according to claim 10, wherein the fin is homogeneous.

14. The fin according to claim 10, wherein the fin is made from a material selected from the group consisting of aluminum, copper, iron, nickel, magnesium, titanium, intermetallic alloys, refractory metals, ceramics, tool alloys, polymers, polymer composites, elastomers, epoxies, semiconductors, glasses and metallic glasses.

15. The fin according to claim 10, wherein the thermal energy is received in the base portion and dissipated to the fluid through the outer surfaces of the first and second side portions.

* * * * *